US005180217A

United States Patent [19]

Lautenschläger

[11] Patent Number: 5,180,217

[45] Date of Patent: Jan. 19, 1993

[54] METAL DRAWER SIDES

[75] Inventor: Horst Lautenschläger, Reinheim, Fed. Rep. of Germany

[73] Assignee: Karl Lautenschläger GmbH & Co. KG, Reinheim, Fed. Rep. of Germany

[21] Appl. No.: 849,786

[22] Filed: Mar. 10, 1992

Related U.S. Application Data

[63] Continuation of Ser. No. 592,196, Oct. 3, 1990, abandoned.

[30] Foreign Application Priority Data

Oct. 14, 1989 [DE] Fed. Rep. of Germany ..... 3934419

[51] Int. Cl.[5] ..... A47B 88/00

[52] U.S. Cl. ..... 312/334.7; 312/330.1

[58] Field of Search ..... 312/330.1, 348.1, 349, 312/351, 334.7, 348.2

[56] References Cited

U.S. PATENT DOCUMENTS 4,120,545 10/1978 Happak et al. ..... 312/330.1

4,911,509 3/1990 Rock et al. ..... 312/348.1

*Primary Examiner*—Kenneth J. Dorner

*Assistant Examiner*—Gerald A. Anderson

[57] ABSTRACT

Drawer side wall of metal having a web forming the vertical side of the drawer, from whose bottom and top horizontal margin a bottom flange and a top flange respectively project, as a support for the drawer bottom on the one hand and for the stiffening of the drawer side on the other. On the side of the web wall lying opposite the bottom flange an open-bottomed channel is provided in its bottom area for the concealed accommodation of the runner of a drawer guide. The drawer side is made from at least two members bent from sheet metal, the one including the upper part of the web and the upper flange and the other member including the lower part of the web and the bottom flange holding the drawer bottom. The members are superimposed on one another along a narrow strip and fastened together.

2 Claims, 2 Drawing Sheets

METAL DRAWER SIDES

This application is a continuation of application Ser. No. 07/592,196, filed Oct. 3, 1990, now abandoned.

BACKGROUND OF THE INVENTION

The invention relates to metal drawer sides, having a web which forms the vertical side of the drawer, and from whose bottom and top horizontal margins top and bottom flanges project laterally as a support for the drawer bottom in the one case and for the stiffening of the drawer side in the other, while on the side of the web opposite the drawer-bottom flange, in the bottom part of the web, an open-bottomed channel is provided for the concealed accommodation of the runner of a drawer guide.

In built-in furniture and in cabinet construction, drawers are being used increasingly in certain applications, which are made from plastic or metal. Drawers having sides made of metal are being used especially for large drawers of great capacity, intended for the accommodation of heavy objects, i.e., which are exposed to heavy loading. The metal stock that is used in this case is made of light-metal alloys which in addition to the required strength have the advantage of light weight. Since it can be made by extrusion it can be given cross-sectional profiles offering the possibility of concealing the hardware for joining the drawer sides to the drawer backs and/or fronts, supporting the drawer bottom, and concealing the runner of the drawer guide. The metal stock extruded from aluminum alloys, however, is comparatively expensive on account of the need for heavy investment in extruding machinery and dies.

It is therefore the object of the invention to create metal drawer sides which can be made, even in comparatively small quantities, at a much lower cost than the above-mentioned extruded metal drawer sides of the prior art, without sacrificing load-carrying capacity or detracting from the appearance of the drawer sides.

THE INVENTION

This object is achieved in accordance with the invention by making the drawer side from at least two pieces of bent sheet metal, one of them comprising the upper portion of the web and the upper flange and the other the lower part of the web and the bottom flange supporting the drawer bottom, these pieces being placed one over the other and fastened together. Since bending presses are usually available in metalworking factories the investment in an extrusion press and special extrusion dies is unnecessary, so that the drawer-side according to the invention can be manufactured more cheaply, especially in comparatively small quantities, than the known extruded aluminum alloy drawer sides.

The upper member of the drawer side best includes the top flange and the portion of the web that is visible inside of the drawer, while the lower member includes the bottom flange provided for the support of the drawer bottom, plus an upright web portion adjoining the bottom flange and having, for the formation of the area of attachment to the web of the upper member, a height which is greater than the thickness of the associated drawer bottom, the channel for containing the runner of the drawer being formed from the upper margin of the upright web portion by two downward bends.

The bottom margin of the web of the upper piece is preferably rounded over arcuately in cross section in the same direction as the bottom flange, so that in a drawer made by using such a drawer side the area of transition between the drawer side and the drawer bottom will be in the form of a rounded cove molding and will therefore be very easy to clean.

The upper and lower members are best joined together by welding together the superimposed flat portions of their webs, electrical resistance welding methods such as projection welding, spot welding or rolling seam welding being preferred.

The invention will be further explained below in connection with the drawing, wherein:

DESCRIPTION OF PREFERRED EMBODIMENTS

Figure 1:
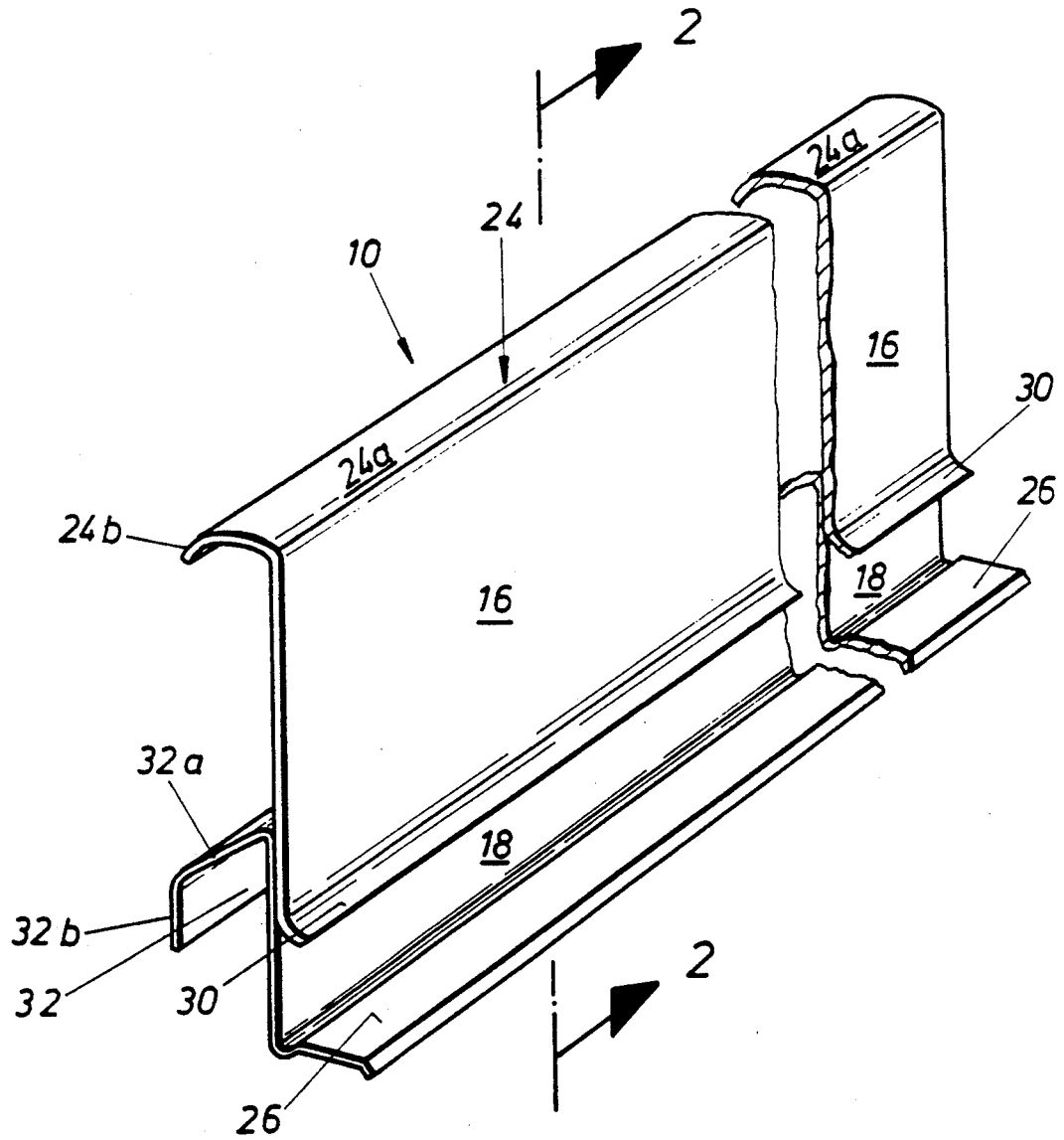
FIG. 1 is a perspective view of a sheet-metal drawer side made in the manner in accordance with the invention.
Figure 2:
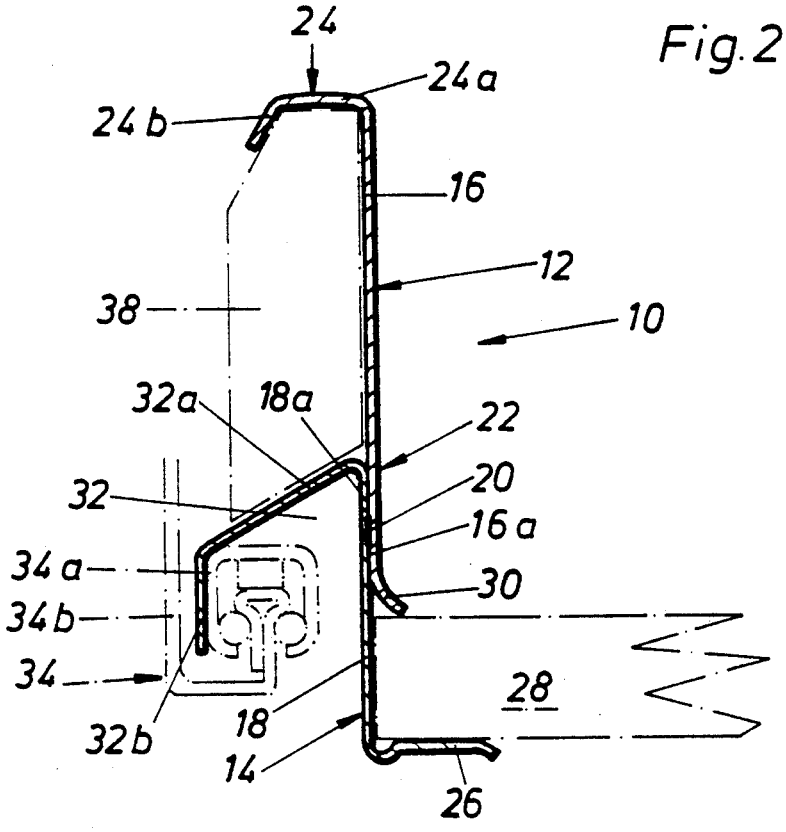
FIG. 2 is a side view as seen in the direction of arrows 2—2 in FIG. 1.

FIGS. 1 and 2 show a drawer side identified as a whole by 10, which is composed of an upper member 12 and a lower member 14, each having been bent to the desired cross-sectional shape from an originally flat strip of sheet metal, and then bonded together.

The cross-sectional shapes of members 12 and 14 and the cross section of the drawer side 10 produced by joining these members together can be seen especially in FIG. 2. The upper member 12 and the lower member 14 each have a vertical web section 16 and 18, respectively, which are superimposed on one another at a lower and upper portion **16*a* and 18*a*, respectively, of the web, and are fastened together by welding at 20 to form the vertical web 22 of the entire drawer side 10**.

At the upper margin of the web 16 of the upper member 12, two bends are made along parallel lines, the first outwardly at right angles from the web 16, and then at its margin remote from the web an additional, narrower portion **24*b* is bent downwardly at an angle. The bent portions 24*a* and 24*b* stiffen the web 16, and thus the drawer side web 22 as a whole, against deflection. At the lower margin of the web 18 of the lower member 14 a narrow portion 26 is bent inwardly at right angles, i.e., in a direction opposite that of portion 24*a*; in addition to its function of stiffening the web 22, this portion serves to form a ledge to support the drawer bottom 28 indicated in broken lines in FIG. 2. The bottom margin of web portion 16 is curved inwardly in cross section below the weld 20 at 30, to form a kind of quarter-round shape, thus forming a rounded cove in the finished drawer between the inner surface of the drawer side and the drawer bottom 28. The open distance between the ledge 26 and the cove 30 at the bottom of the web is best made equal to the thickness of the drawer bottom 28, so that the latter will fit exactly between the shelf 26 and the cove 30. Nevertheless it will, of course, be possible to use thinner drawer bottoms, in which case when the drawer is assembled a filler strip of appropriate thickness must be inserted between the ledge 26 and the drawer bottom to assure that the upper side of the drawer bottom 28 inside of the drawer will be urged tightly against the cove 30 of the web 16**.

By making two bends of flat sheet metal material 32*a* and 32*b* along parallel lines at the upper margin of web 18 of the lower member 14 of the drawer side the open-bottomed channel 32 is formed which serves to conceal and contain the runner 34*a* of a drawer guide 34, indicated in broken lines in FIG. 2, the guide rail 34*b* being fastenable as usual to the inside face of the side wall of a cabinet carcase.

In FIG. 2, in the area between the upper side of the outwardly bent sheet metal portion 32*a* and the bottom of the outwardly bent portions 24*a* and 24*b* there is represented diagrammatically in broken lines a housing 38 which may be part of hardware by which a drawer front can be adjustably fastened to the front vertical edges of the drawer side member 10. Such hardware is known in itself and is not part of the present invention, so that any further description of the configuration of housing 38 and the manner in which it is fastened to the drawer side 10 can be dispensed with in this connection.

Figure 3:
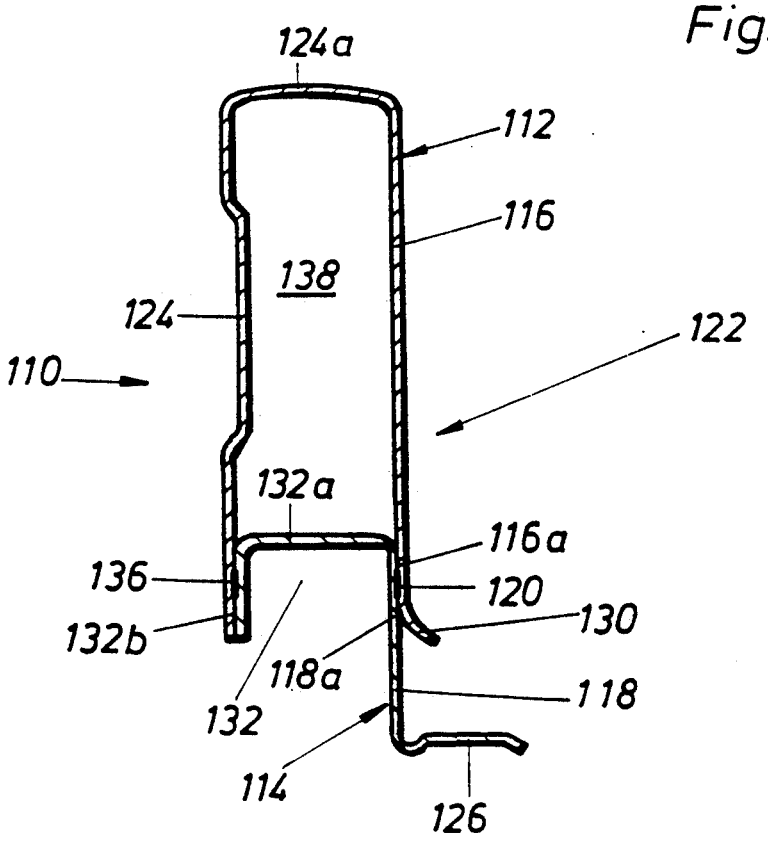
FIG. 3 is a cross section of the same kind as in FIG. 2 through a modified embodiment of a drawer side in accordance with the invention.

FIG. 3 presents a modified embodiment of a drawer side 110, which is basically similar in construction and design to the above drawer side 10 so that it will suffice to describe only the differences and further developments in relation to the above drawer side 10, and, insofar as identical features are concerned, the above description of FIGS. 1 and 2 can be consulted, inasmuch as functionally equal parts of the drawer sides 10 and 110 are given the same reference numbers, preceded by a "1."

The essential difference between drawer side 110 and drawer side 10 is that the narrow portion 24*b* is widened to form the portion 124 whose width is about equal to the height of the web portion 116. Furthermore, portion 124 is bent downwardly at approximately right angles to portion 124*a*, with its free margin overlapping portion 132*b* of the lower member 114 and welded together with this portion 124 in the overlapping area 136. The drawer side 110 that is thus created above the channel 132, intended to receive the runner of the drawer guide, forms a chamber 138 closed all around except at the ends, in which connecting hardware or parts of such connecting hardware can be concealed for attaching the front and back of a corresponding drawer.

The welds indicated merely schematically in the drawings at 20, 120 and 136 are best produced by appropriate electrical resistance welding methods, such as spot welding, rolling seam welding or projection welding, without excluding other possibilities for joining together the superimposed portions of the members 12 and 14 or 112 and 115. Thus it is quite conceivable that the members can be joined together mechanically by riveting or by joggling by means of tongues stamped from the one part and crimped in openings in the other part.

I claim:

1. A metal drawer side comprising a vertical web formed by an upper vertical web section and a lower vertical web section, a lower portion of said upper vertical web section and an upper portion of said lower vertical web section being superimposed on one another and rigidly fastened together by welding, said upper vertical web section having an upper marginal area which is bent outwardly substantially at right angles for stiffening said upper vertical web section, and said lower vertical web section having a lower marginal area which is bent in a direction opposite to that of said upper marginal area for stiffening said lower vertical web section and to provide a support for a drawer bottom, said lower vertical web section having an upper marginal area which is bent in a direction opposite to that in which said lower marginal area thereof is bent in a manner such as to form an open-bottomed channel for concealingly containing a runner of a drawer guide, and said upper vertical web section having a lower marginal area which is bent arcuately in the same direction as said lower marginal area of said lower vertical web section to form a rounded cove at said lower marginal area of said upper vertical web section, said cove being located above said lower marginal area of said lower vertical web section at a distance to hold said drawer bottom therebetween.

2. A metal drawer side according to claim 1, wherein said upper and lower vertical web sections are fastened together by electrical resistance welding.

* * * * *